US006009583A

United States Patent [19]

Swanstrom, Jr.

[11] Patent Number: 6,009,583

[45] Date of Patent: Jan. 4, 2000

[54] PLIERS-KNIFE COMBINATION

[75] Inventor: John E. Swanstrom, Jr., Duluth, Minn.

[73] Assignee: Swanstrom Tools USA Inc., Superior, Wis.

[21] Appl. No.: 08/966,884

[22] Filed: Nov. 10, 1997

[51] Int. Cl.[7] ..... B25B 7/22; B25B 7/14; B26B 11/00; B25F 3/00

[52] U.S. Cl. ..... 7/133; 7/158; 30/145; 81/325

[58] Field of Search ..... 7/106, 125, 132, 7/133, 134, 135, 158; 30/123, 145; 81/324, 318

[56] References Cited

U.S. PATENT DOCUMENTS

| | | | |
|---|---|---|---|
| 52,645 | 2/1866 | Kellogg . | |
| 329,503 | 11/1885 | Tateum . | |
| 400,690 | 4/1889 | Kimball . | |
| 445,972 | 2/1891 | Caldwell . | |
| 1,331,793 | 2/1920 | Wojdacz | 7/133 |
| 1,561,993 | 11/1925 | Nielsen . | |
| 2,334,781 | 11/1943 | Maines . | |
| 2,651,227 | 9/1953 | Kennington, Jr. | 81/305 |
| 3,742,957 | 7/1973 | White . | |
| 3,762,019 | 10/1973 | Epstein . | |
| 3,858,258 | 1/1975 | Stevens . | |
| 3,947,905 | 4/1976 | Neff | 7/5.6 |
| 4,208,749 | 6/1980 | Hermann et al. | 7/106 |
| 4,669,140 | 6/1987 | Miceli | 7/158 |
| 4,744,272 | 5/1988 | Leatherman . | |
| 4,898,161 | 2/1990 | Grundei . | |
| 5,007,313 | 4/1991 | Jeromson, Jr. et al. . | |
| 5,101,563 | 4/1992 | d'Orgelys . | |
| 5,212,859 | 5/1993 | Hagerty . | |
| 5,458,029 | 10/1995 | Walsky . | |
| 5,515,587 | 5/1996 | Pool . | |

*Primary Examiner*—David A. Scherbel
*Assistant Examiner*—Philip J Hoffmann
*Attorney, Agent, or Firm*—Faegre & Benson LLP

[57] ABSTRACT

A pliers-knife combination tool including pivotally connected elongated members. A working region of the tool includes opposed gripping jaws on interior faces of the elongated members and at least one knife edge on an exterior edge of one of the elongated members. Engaging the opposed gripping jaws with each other allow use of the tool as a knife. A method of fabricating the tool includes maximizing the size of the tool for a given size forming machine. Each member is formed separately from the other member to permit sizes as large as possible for the forming dies and machines used. The members are pivotally connected after forming to produce a larger size tool than if both the first and second members were simultaneously formed in a given size forming machine.

18 Claims, 5 Drawing Sheets

60
22
64
62
24
66
12
14
10
57a
56a
55b
58
40
40a
42
42a
98a
95b
49a
96a
98b
95b
49b
96b 63a
63b
63
54
63c
61a
61b
61
61c

PLIERS-KNIFE COMBINATION

TECHNICAL FIELD

The present invention is in the field of multiple use hand tools. More specifically, the present invention is directed to a multiple use hand tool having gripping jaws and knife blades.

BACKGROUND

Multiple use hand tools having gripping jaws or pliers and a knife blade or plurality of knife blades are known in the art. For example Nielsen, U.S. Pat. No. 1,561,993 issued Nov. 17, 1925, is directed to a gripping tool having a knife blade in a handle thereof. Further, Leatherman, U.S. Pat. No. 4,744,272, issued May 17, 1988 is directed to a pliers-type gripping tool having multiple tools, including a knife blade, in a handle portion thereof However, some manipulation of the tools disclosed by both Nielsen and Leatherman is required to switch from use of the gripping tool to use of a knife blade. Further, both Nielsen and Leatherman disclose a multiple use tool having a knife blade with only a single edge. Accordingly, there is a continuing need for improved combination tools having a gripping tool and a knife edge. In particular, manipulation required to switch from use of the gripping tool to the knife edge should be minimal. Also, fabrication of a multiple purpose tool should be so as to allow the largest tool possible for a given capacity forming machine.

DETAILED DESCRIPTION

Figure 1:
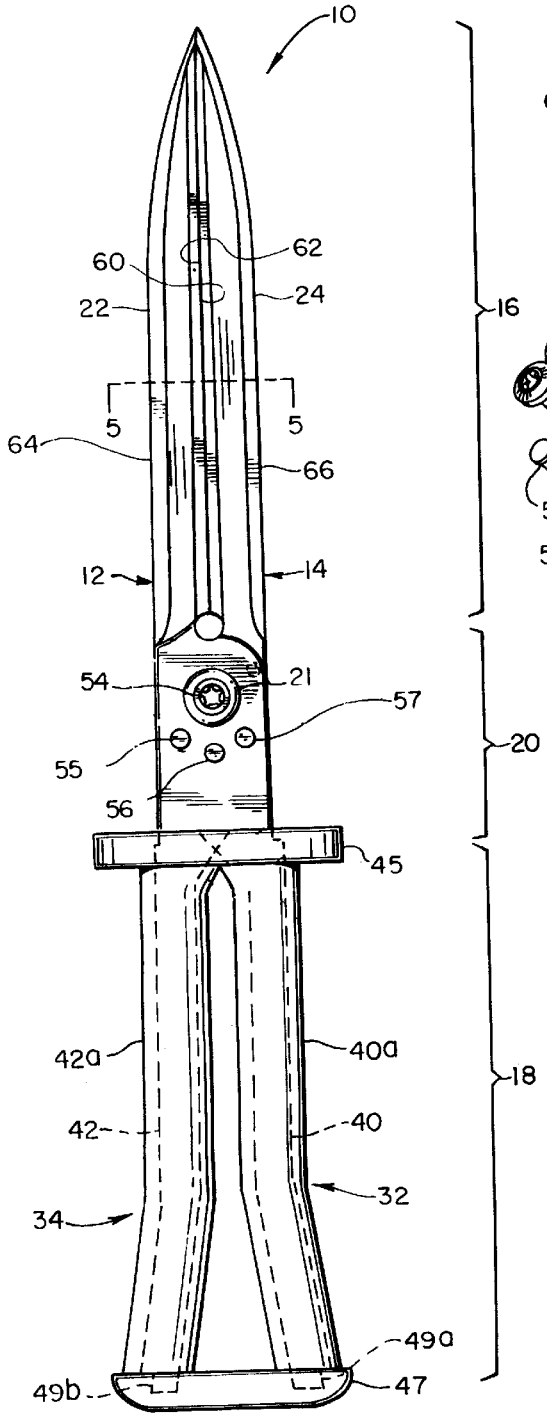
FIG. 1 is a side view of a pliers-knife combination tool in accordance with the present invention shown in a closed position.

FIG. 1 shows a multiple hand tool in accordance with the present invention. Tool 10 is a pliers-knife combination tool formed from a first rigid elongated member 12 and second rigid elongated member 14. A handle portion 18 of tool 10 is formed from a proximal section 32 of elongated member 12 and a proximal section 34 of elongated member 14. A working region 16 of tool 10 is formed from a distal section 22 of elongated member 12 and a distal section 24 of elongated member 14. Tool 10 has a pivot region 20, which includes pivot 21, between the working region 16 and the handle portion 18.

The handle portion 18 of tool 10 provides a user interface which allows an operator to manipulate tool 10 and includes a first grip 40 and a second grip 42. Grips 40 and 42 are each formed from elongated members extending proximally from the pivot region 20 of tool 10. Grip 40 is preferably substantially parallel to grip 42 in a region near pivot region 20. As grips 40 and 42 extend further from pivot region 20, they diverge from one another. Grip cover 40*a* is placed over grip 40 and grip cover 42*a* is placed over grip 42. Grip covers 40*a* and 42*a* can be frictionally retained on grips 40 and 42, respectively, formed in place, or attached thereto by adhesive or other known means. Grip covers 40*a* and 42*a* can be formed from a foam elastomeric material including, but not limited to, foamed poly-vinyl chloride (PVC) available from Plastomeric Inc. of Waukesha, Wis.

Figure 2:
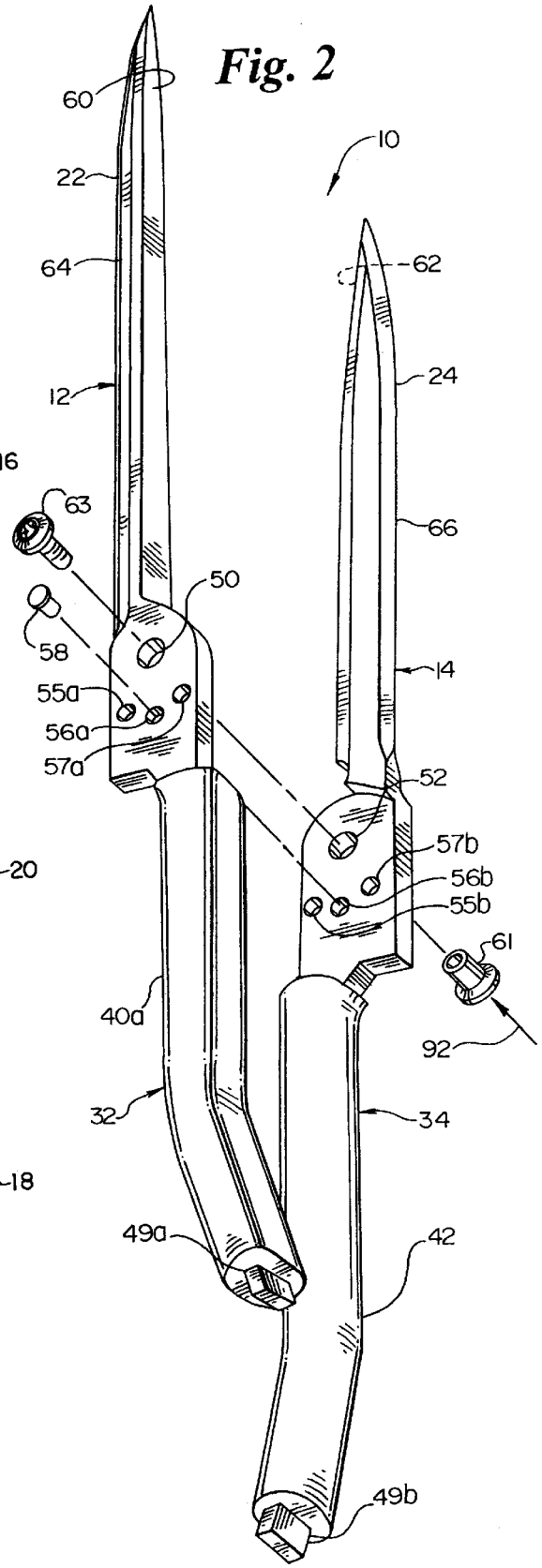
FIG. 2 is an exploded perspective view of the pliers-knife combination tool shown in FIG. 1.

The pivot region 20 of tool 10 allows first rigid elongated member 12 and second rigid elongated member 14 to pivot with respect to one another. As shown in FIG. 2, the pivot region 20 includes a first aperture 50 formed in first member 12 and aligned with a second aperture 52 formed in second member 14. Apertures 50 and 52 each have cylindrical interiors. Pivot 21 includes generally cylindrical fastener 54 which passes through apertures 50 and 52 and is aligned with the cylindrical interiors of apertures 50 and 52. The portions of members 12 and 14 that are included in pivot region 20 are flat in a plane orthogonal (or perpendicular) to a cylindrical axis 92 of cylindrical fastener 54 and the cylindrical interiors of apertures 50 and 52. Fastener 54 movably holds the flat part of first member 12 against the flat part of second member 14. As such, members 12 and 14 can pivot with respect to each other in the plane orthogonal to the cylindrical fastener 54 which is the plane of motion of tool 10.

Figures 3, 4:
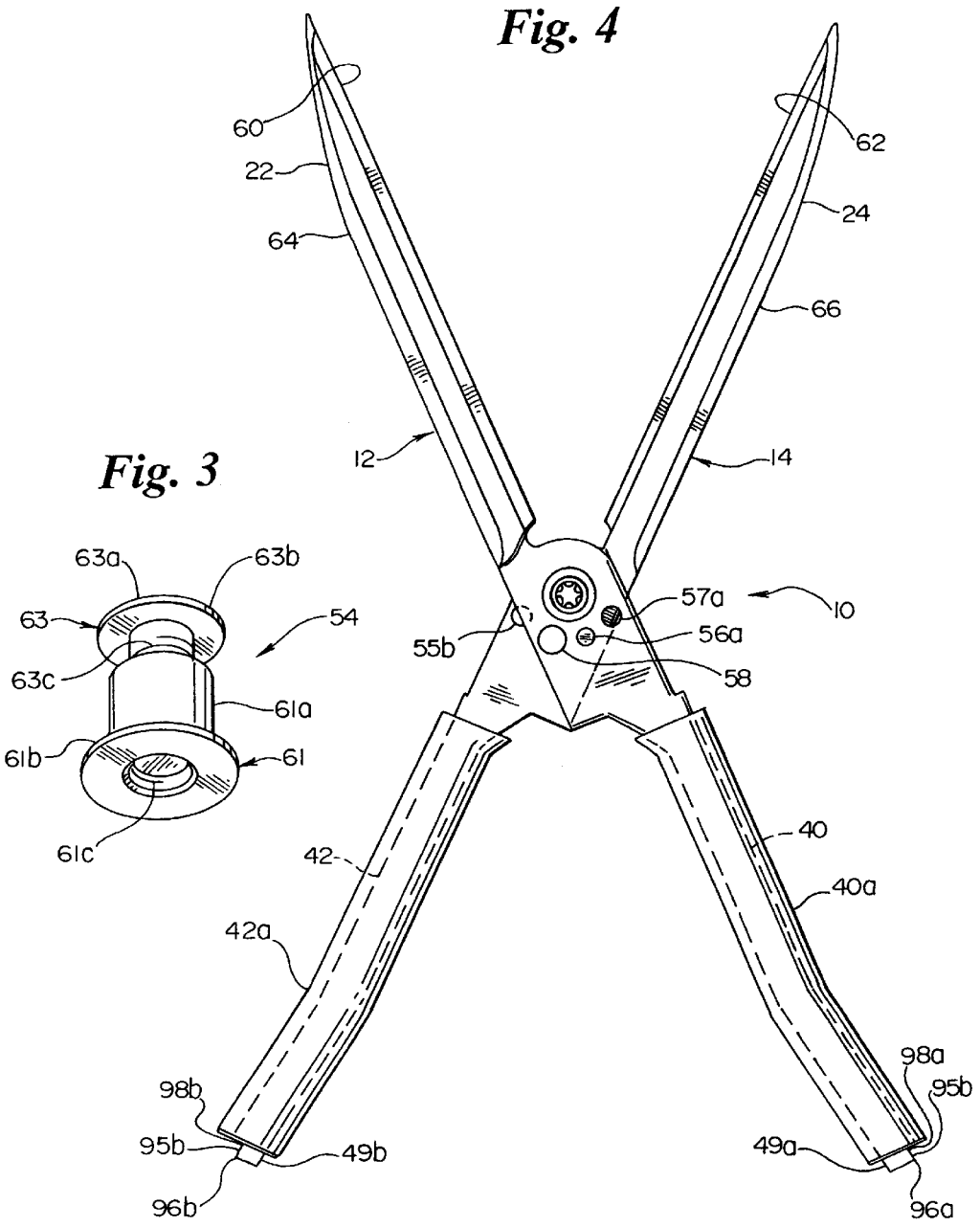
FIG. 3 is an perspective view of the pivot shown in FIG. 1.
FIG. 4 is a side view of the pliers-knife combination tool shown in FIG. 1 in a first open position.

As shown in FIGS. 2 and 3, fastener 54 preferably includes a female mating member 61 and a male mating member 63. Female mating member 61 includes a hollow cylinder 61*a* extending from flange 61*b* and having interior threads 61*c*. Male mating member 63 includes a screw 63*a* having a head 63*b* and exterior threads 63*c* sized to mate with interior threads 61*c* of member 61. Aperture 52 is sized to pivotally accommodate cylinder 61*a*. However, flange 61*b* prevents member 61 from passing entirely through aperture 52. Also, the diameter of aperture 50 is slightly smaller than that of aperture 52, as such, cylinder 61*a* must be pressed into aperture 50 in an interference fit. Accordingly, to pivotally fasten member 12 to member 14, member 61 is placed through aperture 52 and cylinder 61*a* is pressed into aperture 50. Threads 63*c* of screw 63*a* are then fully engaged with the threads 61*c* of member 61 to secure member 61 in apertures 50 and 52. In this way, member 61 can rotate within aperture 52 of member 14 and not within aperture 50 of member 12 as member 12 and 14 are rotated relative to one another. It is also within the ambit of the present invention to pivotally connect member 12 to member 14 by other conventional pivot members such as, but not limited to, screws and rivets.

Working region 16 of tool 10 extends distally from pivot region 20 and includes first gripping jaw 60 and second gripping jaw 62. Gripping jaw 60 is formed by an interior edge of the distal section 22 of first member 12 and extends along a straight path from pivot region 20 to the distal tip of member 12. Likewise, gripping jaw 62 is formed by an interior edge of the distal section 24 of second member 14 and extends along a straight path from pivot region 20 to the distal tip of member 14. Gripping jaw 60 faces gripping jaw 62 and the two surfaces engage one another when tool 10 is in a closed position as shown in FIG. 1. As shown in FIG. 4, when tool 10 is in an open position, jaws 60 and 64 are disengaged to allow for insertion therebetween of a work object to be gripped and frictionally retained by tool 10. It is to be understood that jaws 60 and 62 may be smooth-surfaced, serrated, knurled, or otherwise machined in a conventional manner.

An exterior edge of the distal section 22 of first member 12 includes a knife edge 64. Also, in the embodiment of FIGS. 1 and 2, an exterior edge of the distal section 24 of second member 14 includes a knife edge 66. As knife edge 64 extends towards the distal tip 17 of first member 12, it preferably curves towards gripping jaw 60 and comes to a point where it meets gripping jaw 60 at the distal tip 17 of member 12. Likewise, as knife edge 66 extends towards the distal tip 19 of second member 14, knife edge 66 preferably curves towards gripping jaw 62 and comes to a point where it meets gripping jaw 62. As such, when tool 10 is in a closed position, the working region 16 forms a double edged knife blade having a pointed tip. It is also within the ambit of the present invention that tool 10 include only a single knife edge, that is, either knife edge 64 or 66 but not both, such that when tool 10 is in a closed position, the working region 16 forms a single edged knife blade having a pointed tip.

An advantage of forming a knife edge on one or both members 12 and 14 is that, essentially, a T-beam type structure results with the knife edge portion forming the upright and the gripping jaw 60 or 62 forming the crossbar. Such a structure provides tool 10 with higher strength to weight ratio in the plane of motion of tool 10 than a conventional, non-T-beam type structure pliers would have.

Additionally, it is also contemplated to form distal tip 17 of member 12 and/or distal tip 19 of member 14 into a screwdriver head rather than a pointed tip. The screwdriver head or heads can be either a standard flat-blade type head or a crossed-blade type head such as a Phillips head.

In the embodiment of FIGS. 1 and 2, tool 10 is formed such that first member 12 completely crosses second member 14 in the pivot region 20. That is, the distal section 22 of first member 12 is on the opposite side of second member 14 in the plane of motion of tool 10 than is the proximal section 32 of member 12. As such, when tool 10 is in the closed position, that is, when gripping jaw 60 is engaged with gripping jaw 62, first grip 40 is in its position of closest proximity to second grip 42 and spreading apart grips 40 and 42 opens jaws 60 and 62. In this way, tool 10 can be used as a standard pliers; when an operator spreads grips 40 and 42, jaws 60 and 62 are opened to allow for insertion of a work object. The operator can then frictionally grip the work object (not shown) in jaws 60 and 62 by grasping grips 40 and 42 simultaneously to close jaws 60 and 62.

Figure 5:
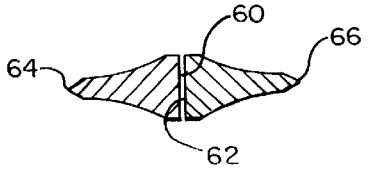
FIG. 5 is a section view of the pliers-knife combination tool shown in FIG. 1 taken along line 5—5 of FIG. 1 showing the interior of the gripping jaws.
Figure 6:
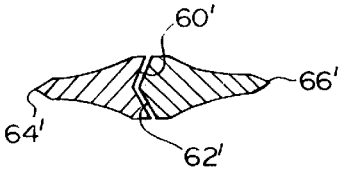
FIG. 6 is a section view of the pliers-knife combination tool shown in FIG. 1 taken along line 5—5 of FIG. 1 showing an alternate interior of the gripping jaws.

FIG. 5 shows a section view of tool 10 taken along line 5—5 of FIG. 1. As shown in FIG. 5, jaws 60 and 62 can be substantially flat. FIG. 6, shows an alternate embodiment of the first and second gripping jaws of tool 10. In FIG. 6, first gripping jaw 60' is formed into a generally V-shaped edge and second gripping jaw 62' is formed into a mating, generally V-shaped groove configured to accommodate edge 60'. It is also within the ambit of the present invention to form only a portion of jaw 60 into a V-shaped edge and a corresponding portion of jaw 62 into a V-shaped groove. Using such a "nesting" configuration will aid in maintaining alignment of members 12 and 14 when closed.

Figure 8:
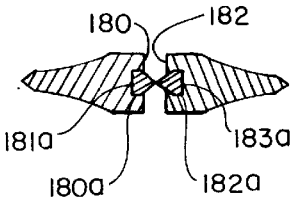
FIG. 8 is a sectional view of the pliers-knife combination tool shown in FIG. 4 taken along line 8—8 of FIG. 7.
Figure 9:
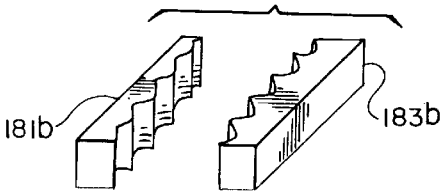
FIG. 9 is a perspective view of a pair of gripping jaw inserts insertable into the pliers-knife combination tool shown in FIG. 7.
Figure 7:
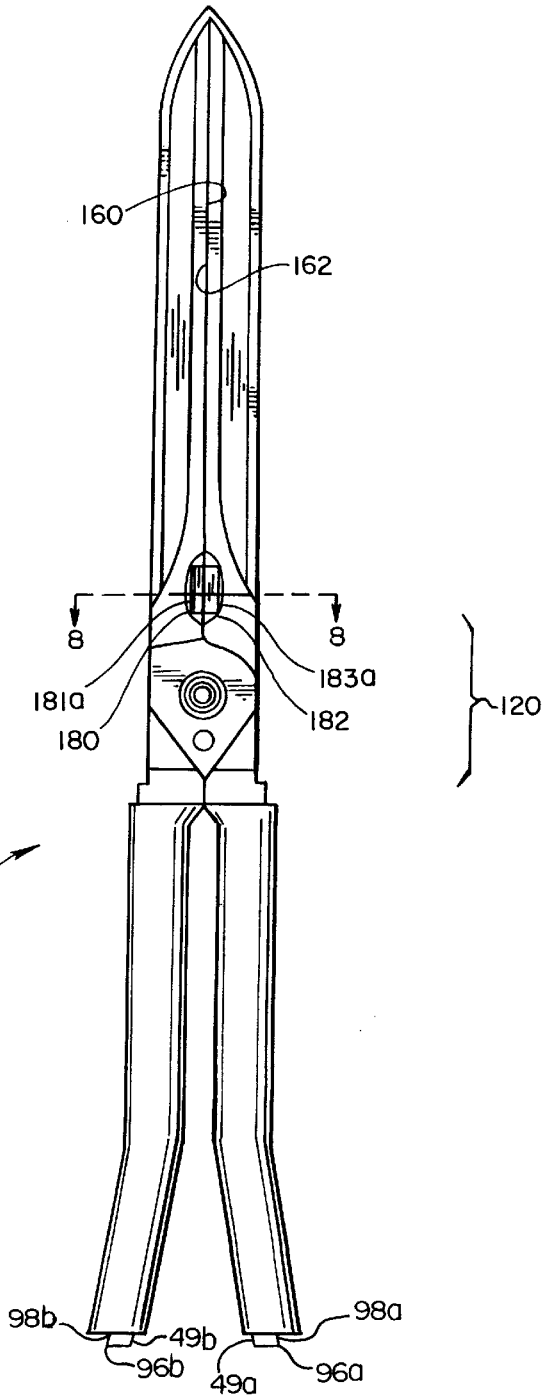
FIG. 7 is a side view of a second embodiment of a pliers-knife combination tool including gripping jaw inserts in accordance with the present invention.

Another embodiment of the present invention is shown in FIG. 7. Elements in FIG. 7 functionally similar to those shown in FIGS. 1 and 2 are labeled with like numerals incremented by 100. FIG. 7 shows tool 110 having first gripping jaw 160 and second gripping jaw 162. Adjacent to a pivot region 120 jaw 160 has cutout 180 and jaw 162 has cutout 182. As shown in FIG. 8, which is a sectional view along line 8—8 of FIG. 4, cutouts 180 and 182 have slots 180*a* and 182*a*, respectively, in which inserts 181*a* and 183*a*, respectively, can be seated and retained. Inserts 181*a* and 183*a* can either be frictionally retained in slots 180*a* and 182*a*, respectively, or respectively affixed therein by adhesive, welding, brazing, or any process known in the art. Inserts 181*a* and 183*a* are generally pentagonal and each have an exposed, sharpened edge. When inserts 181*a* and 183*a* are seated in slots 180*a* and 182*a*, respectively, the exposed edges thereof are opposed so that tool 110 can be used to cut wire or other relatively hard material. Other configurations for inserts for slots 180*a* and 182*a* are also within the scope of the present invention. FIG. 9 shows a perspective view of inserts 181*b* and 183*b* having opposed coarse serrated front faces. It is also contemplated to form the jaws 60 and 62 of tool 10 such that each entire jaw, or any portion thereof, is ridged, or serrated.

In the embodiment shown in FIGS. 1 and 2, pivot region 20 includes apertures 55, 56 and 57. Each aperture includes a locking hole 55*a*, 56*a* and 57*a*, respectively, through first member 12 and a locking hole 55*b*, 56*b*, and 57*b* through second member 14. Apertures 55, 56 and 57 are all of substantially equal diameter and locking pin 58, shown in FIG. 2, is sized to fit therein. In the closed position, locking holes 55*a*, 56*a*, and 57*a* align with locking holes 55*b*, 56*b* and 57*b*, respectively so that by inserting locking pin 58 into aperture 55, 56, or 57, tool 10 is locked in the closed position subject to removal of locking pin 58 from aperture 55, 56, or 57.

Further, locking holes 55*a*–57*a* and 55*b*–57*b* are located in the pivot region 20 such that by opening tool 10 to a predetermined configuration, shown in FIG. 4, locking hole 55*a* will align with locking hole 56*b* and locking hole 56*a* will align with locking hole 57*b*. By placing pin 58 through locking holes 55*a* and 56*b* or through locking holes 56*a* and 57*b*, tool 10 will be locked into the predetermined configuration subject to removal of pin 58. Additionally, locking holes 55*a*–57*a* and 55*b*–57*b* are located in pivot region 20 such that by opening tool 10 to a second predetermined configuration (not shown), locking hole locking 55*a* will align with hole 57*b*. By placing pin 58 through locking holes 55*a* and 57*b*, tool 10 will be locked into the second predetermined configuration subject to removal of pin 58.

Provision of locking holes 55*a*–57*a* and 55*b*–57*b* and pin 58 make it possible for an operator to grasp a work object between jaws 60 and 62, adjust the position of the work object in jaws 60 and 62 such that tool 10 is in a predetermined configuration, and then insert pin 58 through the appropriate holes in pivot region 20 to lock jaws 60 and 62 onto the work object. Although in the embodiment shown in FIGS. 1 and 4, member 12 and member 14 each have only three locking holes in the pivot region 20, it is also to be understood to be within the scope of the present invention to place a greater or lesser number of locking holes in one or both of members 12 and 14 to facilitate locking of tool 10 into configurations other than the first predetermined configuration shown in FIG. 4.

Figure 10:
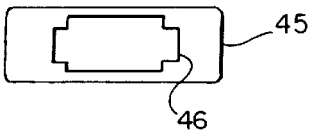
FIG. 10 is a top view of removable locking hilt for use with the pliers-knife combination tool shown in FIG. 1.

Tool 10 can also be provided with a removable hilt for locking tool 10 into a closed position for use as a single or double edged knife. As shown in FIG. 1 and FIG. 10, which is a top view of hilt 45, hilt 45 is a rectangular member having opening 46 through a center region thereof. Opening 46 is sized to fit over the working region 16 and pivot region 20, including pivot 21, of tool 10 and fit snugly over portions of grips 40 and 42 adjacent to pivot region 20 to be frictionally retained thereat. When so positioned, the rigidity of hilt 45 acts to lock grips 40 and 42 in their position of closest proximity and, therefore, tool 10 in its closed position. Thus, placing hilt 45 onto tool 10 as described above facilitates use of tool 10 as a single or double edged knife.

Figure 11:
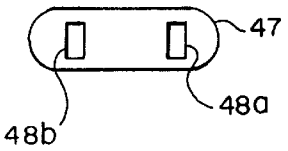
FIG. 11 is a top view of a removable locking cap for use with the pliers-knife combination tool shown in FIG. 1.

Another mechanism whereby tool 10 may be locked into a closed position to allow tool 10 to be used as a single or double edged knife is cap 47 shown in FIG. 1 and FIG. 11, which is a top view of cap 47. Cap 47 is formed in the shape of an oblong, rounded edged disk, and has transverse grooves 48*a* and 48*b*. As shown in phantom in FIG. 1, the proximal tip of grip 40 has lip 49*a* and the proximal tip of grip 42 has lip 49*b*. Lips 49*a* and 49*b* protrude through openings in grip covers 40*a* and 42*a*, respectively. Groove 48*a* is sized to accommodate lip 49*a* and groove 48*b* is sized to accommodate lip 49*b*. Though substantially rigid, grips 40 and 42 are able to be deflected since each forms a cantilevered beam. As such, by placing tool 10 into the closed position, so that grips 40 and 42 are in their position of closest proximity, and then applying additional pressure in a direction that would tend to bring grips 40 and 42 further towards each other, grips 40 and 42 will elastically deflect slightly towards each other. Grooves 48*a* and 48*b* are spaced in cap 47 slightly closer together than lips 49*a* and 49*b* would be if tool 10 were in the closed position and grips 40 and 42 were un-deflected towards each other. As such, to lock tool 10 in the closed position with cap 47, an operator must squeeze grips 40 and 42 towards each other, slightly deflecting grips 40 and 42, and place cap 47 onto tool 10 by engaging groove 48*a* with lip 49*a* and groove 48*b* with lip 49*b*.

Outer edges 95*a* and 95*b* of lips 49*a* and 49*b*, respectively, cant at an angle slightly away from each other and the walls of groove 48*a* and 48*b* which mate with the outer edges 95*a* and 95*b*, respectively, match the angle of this cant. As such, as shown in FIG. 4, the ends 96*a* and 96*b*, of the outer edges 95*a* and 95*b*, respectively, are spaced further apart in cap 47 than the bases 98*a* and 98*b* of the outer edges 95*a* and 95*b*, respectively. As such the force produced by the tendency of grips 40 and 42 to return to their relaxed states acts to keep grooves 48*a* and 48*b* engaged with lips 49*a* and 49*b*, respectively. Thus, cap 47 is effectively held in place by the resiliency of grips 40 and 42. As noted above with respect to hilt 45, by engaging cap 47 with tool 10 as described above, tool 10 is locked in the closed position to facilitate use thereof as a single or double edged knife. Cap 47 can either be completely separable from both grips 40 and 42, as described above, or can be permanently attached to either grip 40 or 42 (but not both) by adhesive, welding, or other attachment method such as a screw or peg driven through cap 47 and into either grip 40 or 42. It is also within the scope of the present invention to hinge cap 47 to either grip 40 or 42.

Figure 17:
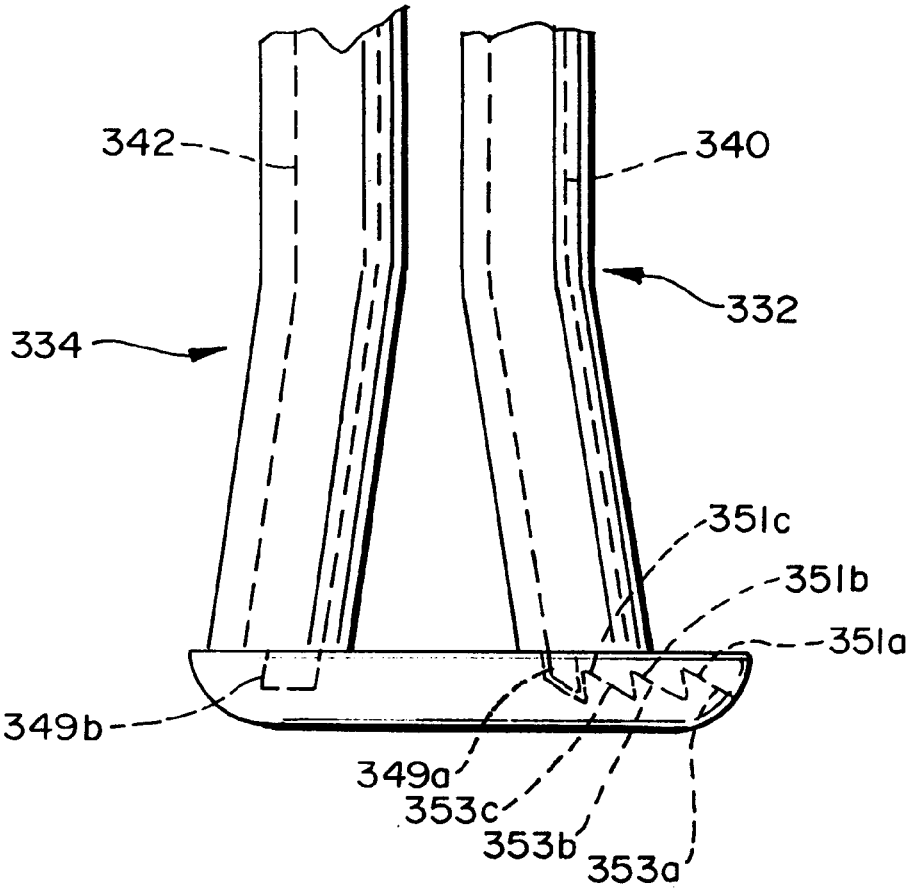
FIG. 17 is a partial front view of the pliers-knife combination shown in FIG. 1 including an alternate embodiment of a locking cap in accordance with the present invention.
Figure 18:
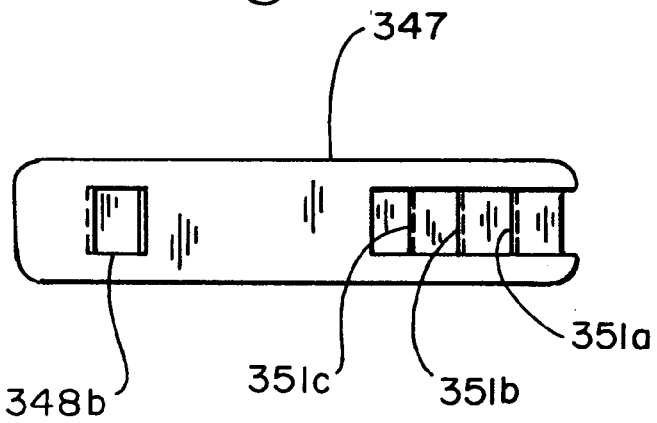
FIG. 18 is a top view of the locking cap shown in FIG. 17.

FIGS. 17 and 18 illustrate an alternate design of a locking cap which is fixedly and permanently attached to grip 42. Elements in FIGS. 17 and 18 functionally similar to those of FIGS. 1 and 2 are labeled with like numerals incremented by 300. In the embodiment shown in FIGS. 17 and 18, cap 347 includes teeth 351*a*, 351*b* and 351*c* having ramps 353*a*, 353*b* and 353*c*, respectively, which, upon drawing grip 340 towards grip 342, are in a path to engage lip 349*a* of grip 40. As noted above, grips 340 and 342 form cantilevered beams and, thus, can deflect. Therefore, by drawing grip 340 towards grip 342 and engaging lip 349*a* with ramp 351*a*, grip 342 can deflect slightly away from grip 340 to allow cap 347 to deflect slightly downward so that lip 349*a* can move up ramp 351*a* of tooth 351*a* and be engaged on the opposite side of tooth 351*a*. In the same way, the remaining teeth 351*b* and 351*c* can also be engaged by lip 349*a*. As shown in FIG. 17, lip 349*a* can be formed narrowly and with an inclined surface so that it closely interfits with teeth 351*a*–351*c*.

By fixedly and permanently attaching cap 347 to the end of grip 342 and providing teeth 351*a*–351*c* in cap 347, it becomes possible for an operator to grasp a work object between gripping jaws (not shown), and then engage lip 349*a* with one of teeth 351*a*–351*c* to lock the gripping jaws onto the work object. To release lip 349*a* from any of teeth 351*a*–351*c*, and, thus, release a gripped work object, downward pressure can be applied on the end of cap 347 in which lip 349*a* is engaged to deflect grip 342 and cap 347. Lip 349*a* can then pass over the top edge of any of the teeth 351*a*–351*c* with which lip 349*a* was engaged to "open" the tool. It is also contemplated to include greater or fewer than 3 teeth in cap 347.

Figure 12:
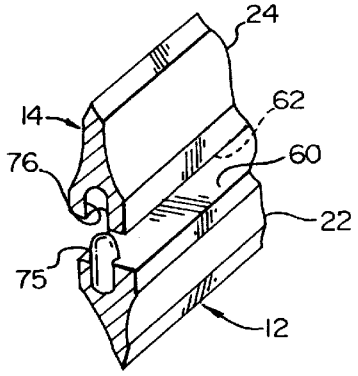
FIG. 12 is a fragmentary detail view of the pliers-knife combination tool shown in FIG. 1 illustrating an alignment retention mechanism.

To enhance the use of tool 10 as a single or double edged knife, an alignment retention mechanism to prevent misalignment of the distal portion 22 of member 12 with the distal portion 24 of member 14 can be provided in the working region 16 of tool 10. As shown in FIG. 12, the alignment retention mechanism can include a protrusion from the surface of jaw 60 aligned with an indentation in jaw 62. When jaws 60 and 62 are engaged, the protrusion engages the indentation to reduce the likelihood of misalignment of the working region 16 of tool 10 when tool 10 is being used. An alignment pin 75 can form the protrusion and a hole 76, positioned to receive and sized to closely interfit with pin 75, can form the indentation. Pin 75 and hole 76 can be located near the distal end of working region 16. Alignment pin 75 protrudes perpendicularly from jaw 60. Hole 76 is formed in jaw 62 perpendicularly thereto and is located such that when tool 10 is in the closed position, alignment pin 75 extends into hole 76. Accordingly, hole 76 restricts the lateral movement of pin 75 with respect thereto and, therefore, the lateral movement of the distal section 22 of member 12 with respect to the distal section 24 of member 14. In this way, pin 75 and hole 76 decrease chances that when using tool 10 as a single or double edged knife, a twisting of tool 10 while engaged with a work object would result in the distal section 22 of member 12 becoming misaligned with the distal section 24 of member 14. Such misalignment could decrease the effectiveness of tool 10.

Figure 13:
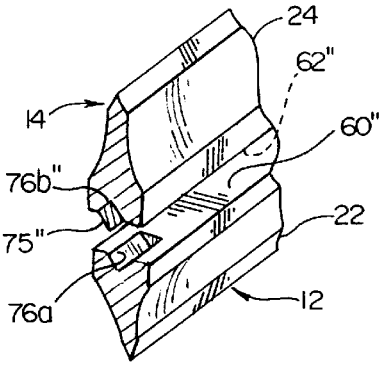
FIG. 13 is a fragmentary detail view of the pliers-knife combination tool shown in FIG. 1 illustrating an alternate alignment retention mechanism.

An alternate form of an alignment retention mechanism is shown in FIG. 13. A portion of jaws 60" and 62" are formed into V-shaped grooves 76*a*" and 76*b*, respectively, and a generally diamond shaped insert 75" is attached to the V-shaped groove 76*a*" of jaw 60" by brazing, welding, or other known means. When jaws 60" and 62" are in a closed position, insert 75" engages groove 76*b*" of jaw 62" to decrease the chances that twisting tool 10 while engaged with a work object will cause lateral misalignment of the working region of tool 10.

Figure 14:
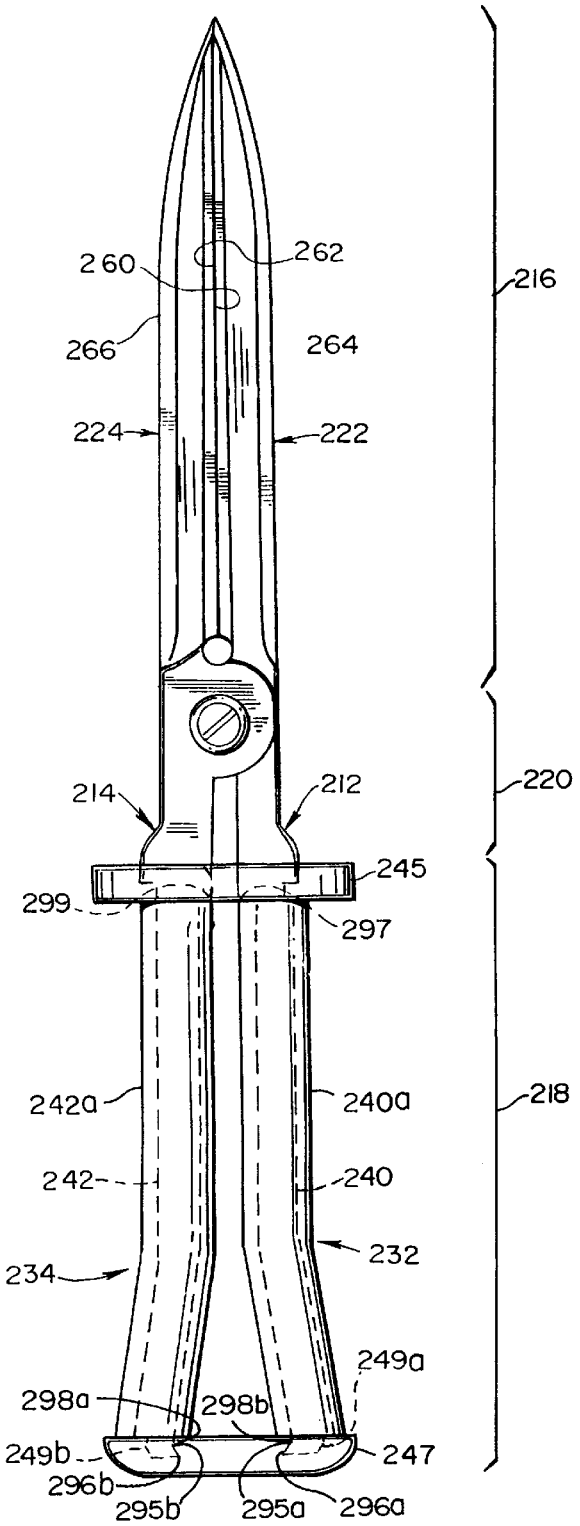
FIG. 14 is a side view of a third embodiment of a pliers-knife combination tool including non-crossing members in accordance with the present invention.

Another embodiment of the present invention is shown in FIG. 14. Elements in FIG. 14 functionally similar to those of FIGS. 1 and 2 are shown with like numerals incremented by 200. FIG. 14 shows a front view of tool 210 which includes a first member 212 and second member 214. A working region 216 of tool 210 includes gripping jaws 260 and 262 on interior edges of members 212 and 214, respectively, and knife edges 264 and 266, respectively, on exterior edges thereof. A handle portion 218 includes a first grip 240; a soft grip cover 240*a*, which covers grip 240 up to ledge 297 of grip 240; a second grip 242; and a soft grip cover 242*a*, which covers second grip 242 up to ledge 299 of grip 242. Handle portion 218 is connected to the working region 216 via pivot region 220 and allows manipulation of the working region 216 by an operator.

In the embodiment shown in FIG. 14, first member 212 does not completely cross second member 214 in the pivot region 220 so that a distal section 222 of first member 212 remains on the same side of second member 214 in the plane of motion of tool 210 as a proximal section 232 of member 212. As such, when first grip 240 and second grip 242 are spread apart, tool 210 is placed in a closed position, and when grips 240 and 242 are pushed together, tool 210 is place in an open position. In this way, an operator can engage the knife edges 264 and 266 with a work object and by gripping together grips 240 and 242, the operator can place outward cutting pressure on the work object or hold the work object open to provide access to an interior of the work object. If it is only desired to hold a work object open, a portion of knife edges 264 and 266 can be dulled or flattened so than a work object is not cut by tool 10 while being held open. It is also contemplated that only a single exterior edge of the working region 216 may be formed into a knife edge.

Figure 15:
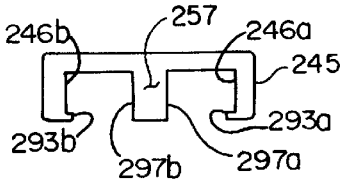
FIG. 15 is a top view of a removable locking hilt for use with the pliers-knife combination shown in FIG. 14.

Similar to hilt 45, a hilt 245 for locking tool 210 into a closed position, that is, a position in which jaws 260 and 262 are engaged with each other, can also be used with tool 210. Hilt 245 is shown in a top view in FIG. 15. Hilt 245 is a rectangular member having openings 246*a* and 246*b* with rigid separating region 257 therebetween. Slots 246*a* and 246*b* are sized to allow retention therein of grips 240 and 242, respectively. Openings 297*a* and 297*b* allow grips 240 and 242, respectively, to pass into slots 246*a* and 246*b*, respectively. Hilt 245 is slightly resilient such that tabs 293*a* and 293*b* can be deflected slightly outwardly to allow hilt 245 to be engaged with regions of grips 240 and 242, adjacent to pivot region 220 and distal to soft grip covers 240*a* and 242*a*, respectively, and there retained by tabs 293*a* and 293*b* when they return to their un-deflected state. When hilt 245 is so positioned, separating region 257 places outward pressure on grips 240 and 242 to hold tool 210 in a closed position. In this way, engaging hilt 245 with tool 210 as described above facilitates use of tool 210 as a single or double edged knife.

Figure 16:
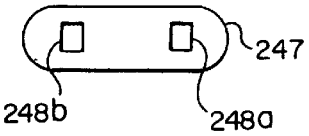
FIG. 16 is a top view of a removable locking cap for use with the pliers-knife combination shown in FIG. 14.

Another mechanism whereby tool 210 may be locked into a closed position to allow tool 210 to be used as a single or double edged knife is cap 247, similar to cap 47, shown in a front view in FIG. 14 and in a top view in FIG. 16. Cap 247 is formed in the shape of an oblong, rounded edged disk, and has transverse recesses or grooves 248*a* and 248*b*. The distal end of grip 240 has lip 249*a* and the distal end of grip 242 has lip 249*b*. Lips 249*a* and 249*b* protrude through openings in soft grip covers 240*a* and 242*a*, respectively. Groove 248*a* is sized to accommodate lip 249*a* and groove 248*b* is sized to accommodate lip 249*b*. Though substantially rigid, grips 240 and 242 are able to be deflected since each forms a cantilevered beam. As such, by placing tool 210 into the closed position, so that grips 240 and 242 are in their widest spread position, and then applying additional pressure in a direction that would tend to widen grips 240 and 242 further, grips 240 and 242 will deflect slightly away from each other. Grooves 248*a* and 248*b* are spaced is cap 247 slightly further apart than lips 249*a* and 249*b* would be if tool 210 were in the closed position and grips 240 and 242 were un-deflected away from one another. As such, to lock tool 210 in the closed position with cap 247, an operator must spread grips 240 and 242 away from each other, slightly deflecting grips 240 and 242, and place cap 247 onto tool 210 by engaging groove 248*a* with lip 249*a* and groove 248*b* with lip 249*b*.

Inner edges 295*a* and 295*b* of lips 249*a* and 249*b* cant at an angle slightly towards each other and the walls of groove 248*a* and 248*b* which mate with the inner edges of lips 249*a* and 249*b*, respectively, the angle of this cant. Therefore, the ends 296*a* and 296*b* of the inner edges 295*a* and 295*b*, respectively, are spaced closer together in cap 247 than the bases 298*a* and 298*b*, respectively, of the inner edges 295*a* and 295*b*, respectively. As such, the force produced by the tendency of grips 240 and 242 to return to their un-deflected states acts to keep grooves 248*a* and 248*b* engaged with lips 249*a* and 249*b*, respectively. Thus, cap 247 is effectively held in place by the resiliency of grips 240 and 242. By engaging cap 247 with tool 210 as described above, tool 210 is locked in the closed position to facilitate use thereof as a single or double edged knife.

It is also contemplated to permanently attach cap 247 to either grip 240 or 242 (but not both) and include teeth in cap 247 similar to teeth 351*a*–351*c* in cap 347 shown in FIGS. 17 and 18. However, the teeth of cap 247 face the opposite direction so as to engage grip 40 or 42 to prevent either grip from moving closer towards each other.

In the configuration shown in FIG. 14, it is to be understood that grips 240 and 242 may be laterally offset out of the plane of rotation to avoid interfering with each other as jaws 212 and 214 are pivoted away from each other, thus allowing a wider range of motion of jaws 212 and 214.

Any of the gripping jaw configurations described above in relation to tool 10 and shown in FIGS. 5, 6, 8, and 9 can also be used with tool 210. Also, an alignment retention mechanism as shown in FIG. 12 or FIG. 13 can also be used with tool 210 to decrease the possibility of misalignment of the working region 216 of tool 210 when being twistedly engaged with a work object. It is also contemplated that locking holes similar to locking holes 55*a*–57*a* and 55*b*–57*b*, shown in FIG. 2, and a locking pin similar to locking pin 58, also shown in FIG. 2, can be used in pivot region 220 of tool 210 to allow tool 210 to be locked in predetermined positions.

Tool 10 is preferably primarily fabricated by forging, but, can also be formed using other methods such as injection molding. If a method is used which requires the use of a die, there is a maximum size die that any given forming machine can accommodate. Further, there is a maximum sized billet that a forming die can accommodate. As such, using a die to form members 12 and 14 simultaneously would not allow a tool 10 to be as large as if a die or dies were used to their maximum capacity for forming members 12 and 14 individually. Accordingly, members 12 and 14 can be formed separately so that the dies can be formed to allow each member 12 and 14 to be of a larger size than if the same die was used to form members 12 and 14 simultaneously. This allows tool 10 to be as large as possible for a given size forming machine. Additionally, both members 12 and 14 can be formed separately using the same die to be substantially identical and oriented to oppose each other for assembly. Forming both members 12 and 14 from the same die facilitates economical manufacturing. It should be noted, however, that after forming members 12 and 14 from the same die to be substantially identical, features such as gripping jaw surfaces can be added which can differentiate members 12 and 14 as final design option may require.

The material used to form members 12 and 14 can be any substantially rigid material and is preferably metal. The metal used to form members 12 and 14 can be steel and is preferably AISI (American Iron and Steel Institute) series 52100 steel or 440c stainless steel.

After forming members 12 and 14 and drilling apertures 50 and 52 to size, fastener 54 is placed through apertures 50 and 52 of members 12 and 14, respectively. Connectors such as fastener 54 are preferably fabricated from stainless steel and can be formed by machining or any other process known in the art. Caps 47 and 247 and hilts 45 and 245 can be fabricated from any rigid material such as, but not limited to, plastic, steel, brass, or bronze in a conventional manner such as injection molding, forging, or machining. Alignment pin 75 can be formed as a part of member 12 or be formed separately and welded, soldered or otherwise attached to member 12 by any process known in the art. Hole 76 can be drilled or otherwise formed in member 14 after forming member 14. Locking holes 55*a*–57*a* and 55*b*–57*b* can be formed in members 12 and 14, respectively, during forming or drilled or otherwise formed in members 12 and 14 after forming members 12 and 14. Locking pin 58 is preferably formed of stainless steel and can be forged or formed by any other process known in the art. Grip covers 40*a* and 42*a* can be placed on grips 40 and 42, respectively, either before or after pivotally attaching member 12 to member 14.

Tool 110 is formed in a similar manner to tool 10. Inserts 181*a*, 181*b*, 183*a*, and 183*b* can be formed by forging or machining and can be fabricated from stainless steel or otherwise from the same steel from which members 112 and 114 are formed. Inserts 181*a*, 181*b*, 183*a*, and 183*b* can be placed in tool 110 either before or after member 112 is pivotally attached to member 114. Tool 210 can be formed in a similar manner to tools 10 and 110.

Though the present invention has been described with reference to preferred embodiments, those skilled in the art will recognize that changes can be made in form and detail without departing from the spirit and scope of the invention.

What is claimed is:

1. A multiple hand tool comprising:

a first elongated member having a distal portion and a proximal portion including a first gripping jaw formed along the interior edge of said distal portion of the first elongated member, a first knife edge formed along the side opposite said interior edge on said first gripping jaw, said first knife edge tapering from said interior edge, said first knife edge on said distal portion of said first elongated member, and a first grip located at said proximal portion of the first elongated member, a second elongated member including a second gripping jaw opposed to the first gripping jaw and formed along the interior edge of said distal portion of the second elongated member, and a second grip located at said proximal portion of the second elongated member;

a pivot for pivotally coupling the first elongated member with the second elongated member such that the first and second grips can be used to manipulate the first and second gripping jaws allowing the hand tool to be used as a pliers and further such that engagement of the first gripping jaw with the second gripping jaw allows the hand tool to be used as a knife in which at least the first knife edge forms the blade.

2. The multiple hand tool of claim 1 including a second knife edge formed along the side opposite said interior edge on said second gripping jaw, said second knife edge tapering from said interior edge, said second knife edge on the said distal portion of the second elongated member such that engagement of the first and second gripping jaws with one another allows the hand tool to be used as a double-edged knife.

3. The multiple hand tool of claim 1 wherein a distal tip of each elongated member is pointed such that engagement of the first and second gripping jaws with each other allows the hand tool to be used as a knife having a pointed tip.

4. The multiple hand tool of claim 1 wherein the first gripping jaw includes a protrusion directed towards the second gripping jaw and the second gripping jaw includes an indentation aligned with the protrusion and sized and shaped to receive the protrusion such that engagement of the first and second gripping jaws causes the protrusion to be engaged with the indentation to maintain lateral alignment of the first and second elongated members.

5. The multiple hand tool of claim 4 wherein the protrusion includes a pin and the indentation includes a hole positioned to receive and sized to closely interfit with the pin.

6. The multiple hand tool of claim 4 wherein the protrusion includes a V-shaped member and the indentation includes a mating V-shaped groove.

7. The multiple hand tool of claim 1 wherein the first and second gripping jaws include serrated faces.

8. The multiple hand tool of claim 1 wherein the first gripping jaw includes a first sharpened edge and the second gripping jaw includes a second sharpened edge opposed to the first sharpened edge such that the first sharpened edge engages the second sharpened edge when the first and second gripping jaws are engaged to allow cutting of relatively hard material.

9. The multiple hand tool of claim 1 wherein the first gripping jaw includes a first slot and the second gripping jaw includes a second slot, the first and second slots for retaining inserts having predetermined surfaces such that the surfaces of the inserts oppose each other when the multiple hand tool is in a closed position.

10. The multiple hand tool of claim 9 including a first insert for engagement in the first slot and a second insert for engagement in the second slot wherein the first and second inserts each has a ridged surface.

11. The multiple hand tool of claim 9 including a first insert for engagement in the first slot and a second insert for engagement in the second slot wherein the first and second inserts each has a sharpened edge and the sharpened edge of the first insert engages the sharpened edge of the second insert when the tool is in a closed position to allow cutting of relatively hard material.

12. The multiple hand tool of claim 1 including a cap having a first groove located and sized to engage and retain the first grip and a second groove located and sized to engage and retain the second grip such that the first and second grooves retain the first and second grips in a position such that the first and second gripping jaws are engaged with each other.

13. The multiple hand tool of claim 1 including a cap having a plurality of teeth and wherein the cap is fixedly attached and extends from the first grip and the plurality of teeth can be removably engaged with the second grip such that by engaging the second grip with one of the plurality of teeth, the multiple hand tool can be retained in a predetermined configuration to grip a work object.

14. The multiple hand tool of claim 1 wherein the first elongated member crosses the second elongated member at the pivot such that the first and second gripping jaws are engaged by pivoting the first grip towards the second grip and the first and second gripping jaws are disengaged by pivoting the first grip away from the second grip.

15. The multiple hand tool of claim 14 including a removable hilt having an aperture sized to allow the first and second gripping jaws and pivot to pass therethrough and to engage the first and second grips such that placement of the first and second gripping jaws and pivot through the aperture in the hilt and engagement of the hilt with the first and second grips locks the first and second gripping jaws in engagement with each other.

16. The multiple hand tool of claim 1 wherein the first grip remains on a same side of the pivot as the first gripping jaw and the second grip remains on a same side of the pivot as the second gripping jaw such that the first and second gripping jaws engage with each other as the first and second grips are pivoted away from each other and the first and second gripping jaws disengage as the first and second grips are pivoted towards each other.

17. The multiple hand tool of claim 16 including a removable hilt having a first aperture sized to allow the first grip to pass therethrough and a second aperture sized to allow the second grip to pass therethrough such that the first and second elongated members can be engaged with the hilt to lock the first and second gripping jaws in engagement with each other.

18. The multiple hand tool of claim 1 including:

at least a first alignment hole in the first elongated member;

at least a second alignment hole in the second elongated member; and an alignment pin;

wherein the first elongated member can be placed in a predetermined pivoted relationship with respect to the second elongated member such that the first alignment hole lines up with the second alignment hole and the alignment pin can be placed through the first and second alignment holes to retain the first member in the predetermined pivoted relationship with the second member.

* * * * *